US009697807B2

(12) United States Patent
Brown, Jr.

(10) Patent No.: US 9,697,807 B2
(45) Date of Patent: Jul. 4, 2017

(54) ELECTRIC GUITAR SYSTEM FOR QUICK CHANGES

(71) Applicant: Peter J. Brown, Jr., Mico, TX (US)

(72) Inventor: Peter J. Brown, Jr., Mico, TX (US)

( * ) Notice: Subject to any disclaimer, the term of this patent is extended or adjusted under 35 U.S.C. 154(b) by 0 days.

(21) Appl. No.: 15/284,833

(22) Filed: Oct. 4, 2016

(65) Prior Publication Data

US 2017/0025102 A1 Jan. 26, 2017

Related U.S. Application Data

(63) Continuation-in-part of application No. 14/702,196, filed on May 1, 2015, now Pat. No. 9,466,269.

(60) Provisional application No. 62/009,548, filed on Jun. 9, 2014.

(51) Int. Cl.

| | |
|---|---|
| ***G10D 1/08*** | (2006.01) |
| ***G10H 3/18*** | (2006.01) |
| ***G10D 3/12*** | (2006.01) |
| ***G10D 3/14*** | (2006.01) |
| ***G10D 3/04*** | (2006.01) |
| ***G10H 1/32*** | (2006.01) |

(52) U.S. Cl.

CPC ..... *G10D 1/085* (2013.01); *G10D 3/04* (2013.01); *G10D 3/12* (2013.01); *G10D 3/146* (2013.01); *G10H 1/32* (2013.01); *G10H 3/18* (2013.01); *G10H 3/181* (2013.01)

(58) Field of Classification Search

USPC ..... 84/267

See application file for complete search history.

(56) References Cited

U.S. PATENT DOCUMENTS

| | | | | |
|---|---|---|---|---|
| 5,125,134 | A * | 6/1992 | Morita | A44C 5/2071 24/303 |
| 5,235,891 | A * | 8/1993 | Klein | G10D 1/085 84/291 |
| 5,252,777 | A * | 10/1993 | Allen | G10H 3/182 84/726 |
| 5,747,711 | A * | 5/1998 | Cavaness et al. | G10D 1/085 84/267 |
| 6,646,189 | B2 * | 11/2003 | Minakuchi | G10D 1/085 84/267 |
| 6,649,817 | B2 * | 11/2003 | Hartill | G09F 7/00 84/267 |
| 8,772,613 | B2 * | 7/2014 | Gembar | G10D 3/06 84/267 |
| 8,829,318 | B1 | 9/2014 | DeLaFrance | |
| 8,874,243 | B2 | 10/2014 | Bennett et al. | |
| 8,901,403 | B2 | 12/2014 | Barnett | |

(Continued)

*Primary Examiner* — Christopher Uhlir

(74) *Attorney, Agent, or Firm* — Gunn, Lee & Cave, P.C.

(57) ABSTRACT

An instant access guitar system allowing easy access to cavities in the body portion of the electric guitar. The cavities are covered by plates, a pick guard, flexible laminates or other suitable cover materials. The covers are held in place by (1) cut-outs in the guitar body and (2) magnets that magnetically attach to magnetic material mounted in the guitar body. The appearance of the guitar may be changed by changing the pick guard and the decorative laminate on the headstock. The sound of the guitar may be changed by having unique pickups and wiring releases pre-built in multiple configurations on multiple pick guards as modules to change in and out of the guitar at will with no tools or solder.

11 Claims, 15 Drawing Sheets

(56) References Cited

U.S. PATENT DOCUMENTS

| | | | | |
|---|---|---|---|---|
| 2008/0105101 | A1* | 5/2008 | Eldring | G10D 1/085 84/291 |
| 2009/0019984 | A1* | 1/2009 | Ouellette | G10D 3/00 84/291 |
| 2010/0024622 | A1* | 2/2010 | Kim | H01F 7/0252 84/291 |

* cited by examiner

ELECTRIC GUITAR SYSTEM FOR QUICK CHANGES

RELATED INVENTIONS

This is a continuation-in-part patent application of U.S. patent application Ser. No. 14/702,196, filed May 1, 2015, which claims priority to Provisional Application for Patent Ser. No. 62/009,548, filed on Jun. 9, 2014.

FIELD OF THE INVENTION

This invention relates to electric guitars and, more particularly, to a method of construction of electric guitars.

BRIEF DESCRIPTION OF THE PRIOR ART

Electric guitars were invented in approximately 1933 with one of the first electrically amplified guitars being designed by George Beauchamp of National Guitar Corporation. The electric guitar uses a pick-up to convert vibrations of its strings into electrical impulses. While different types of pick-ups can be used, the most common pick-up in electric guitars uses the principle of electromagnetic induction. The signals generated are amplified before being sent to a loudspeaker. The electric signal may be altered to add special effects, such as reverberation or beats therein.

With the Big Band era of the 30s and 40s, jazz musicians wanted to amplify their sound. The electric guitar became the most important instrument in pop music. Over the years, the electric guitar has evolved into a stringed musical instrument that is capable of a multitude of sounds and styles. To generate the multitude of sounds and styles, a person must be able to quickly modify the sound created by their guitar.

The sound generated by the electric guitar can be affected by the location of the magnetic pick-ups. Identical pick-ups produce different tones depending upon how near they are to the neck or bridge. Bridge pick-ups produce a bright or trebly timbre and neck pick-ups are warmer and more brassy. The type of pick-up also affects the tone. Dual coil pick-ups sound warm, thick and even muddy. A single coil pick-up sounds clear, bright and perhaps even sharp.

When there is more than one pick-up, a selector switch is normally present. The selector switch selects the outputs of the pickups selected to create a particular sound. For example, the selector switch can select a pick-up creating a honky, nasal or funky sound. Individual pick-ups can also have their own timbre altered by switches.

The pick-ups are typically mounted on a pick guard, which pick guard is attached by screws into the body of the electric guitar. The screw connections of the pick guard prevent one from rapidly changing the pick-ups to modify the sound being created by the electric guitar. The screw connections also prevent rapid modification of the electronics during a performance by a guitar technician.

Many musicians have their favorite guitar. The musicians like to create different sounds with that guitar. That means being able to change or modify the guitar by a guitar technician between sets of different songs. The screw connections into the body of the guitar takes time to insert and remove, time which a guitar technician does not have during a live performance.

In electric guitars, the electronics are normally located in a cavity within the body of the electric guitar. During a performance, it is important to be able to quickly get to the electronics portion of the electric guitar contained within a cavity in the body. By changes in the electronics, the performance of the electric guitar can be changed. Also, any electrical problems with the electric guitar can quickly be fixed if access can be quickly obtained to the electronics. The openings to the body cavities may be under the pick guard, under covers or from the rear of the guitar.

SUMMARY OF THE INVENTION

It is an object of the present invention to provide an apparatus and method for rapidly changing or correcting the electronics of an electric guitar.

It is a further object of the present invention to provide for quick access to the cavities within the body of an electric guitar to allow for modification or correction.

It is another object of the present invention to hold covers over cavities in the body of the electric guitar by magnets.

It is yet another object of the present invention to increase user friendliness and cost effectiveness by providing solderless, tool-less modification and customization of an electric guitar in a minimum amount of time.

It is yet another object of the present invention to reduce the amount of equipment necessary for a touring musician to carry, ship and/or set up while simultaneously reducing costs of maintaining a guitar.

It is yet another object of the present invention to decrease the amount of time a guitar may be down during a musical event in case of circuit failure.

It is still another object of the present invention to enable guitar technicians to swap and trade set ups with a minimum amount of time to access multiple configurations and designs, yet reduce the number of instruments needed.

In the present invention, screws previously used to hold covers on cavities in the body portion of the guitar are replaced with magnets. The electric guitar can be constructed using the magnetic connections for the pick guard, or any covers of cavities in the body of the electric guitar. This allows a guitar technician to rapidly make changes in the guitar or to correct any electronic errors therein.

The magnets eliminate the screws of the traditional pick guard covers to allow instant removal of the pick guard. The underside of the guitar, if it has openings therein, may also have magnetic connections for the rear covers.

Through the use of a string retainer bar, by depressing the vibrato arm, all of the strings of the guitar can simultaneously be disconnected and moved to the side while other changes are being made to the guitar. Not having to disconnect each string individually greatly reduces the amount of time necessary repairs and/or changes.

By use of the magnetic connection the decorative laminate used on the guitar can be changed during a performance so the guitar will have a different look for different songs. Further, the pick-up switch selector is sealed so that it cannot be contaminated because of electrical interference during a performance.

DESCRIPTION OF THE PREFERRED EMBODIMENT

Figure 1:
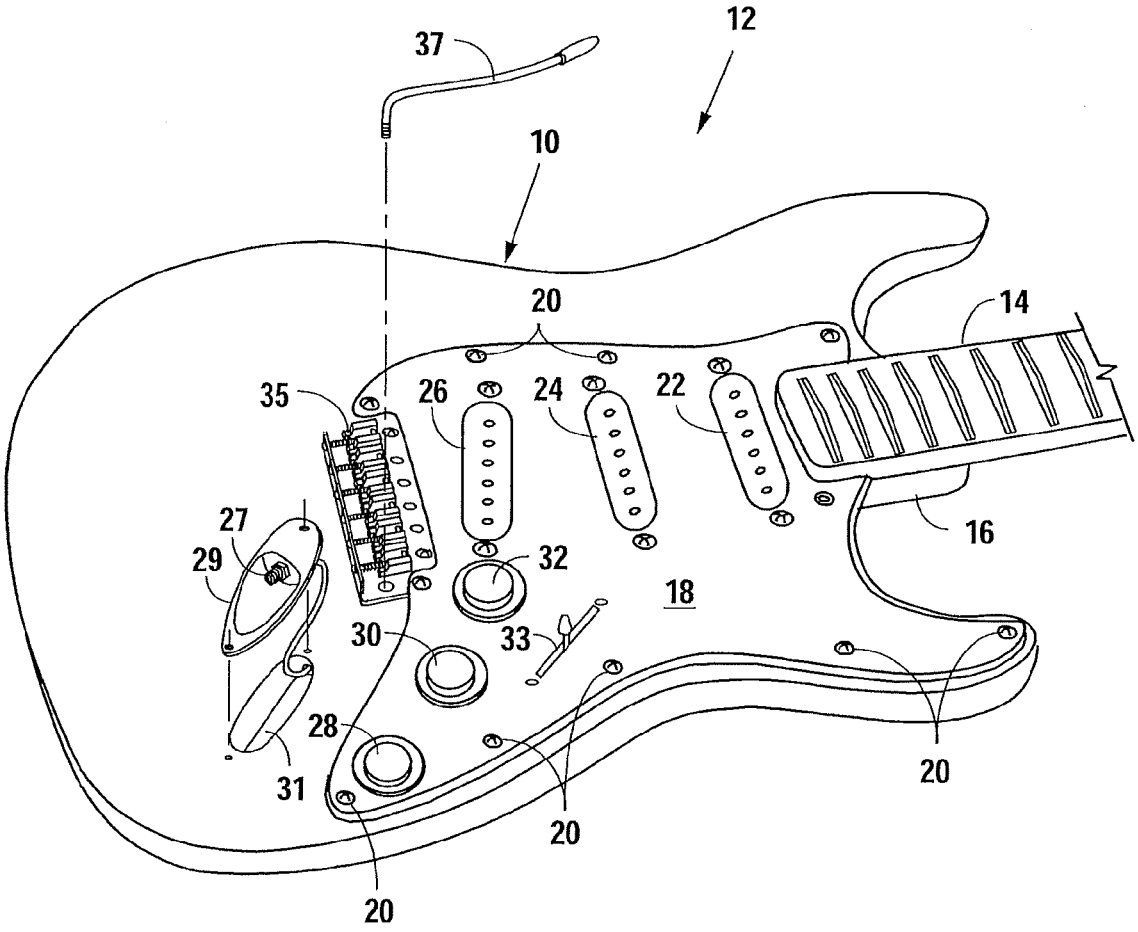
Fig. 1 PRIOR ART
FIG. 1 is a partially exploded, front perspective view of a body portion of a prior art electric guitar with the strings removed.

FIG. 1 is a front perspective view of the body 10 of a typical electric guitar 12. The neck 14 of the electric guitar 12 is connected to the body 10 by the heel 16. On the opposing end of the neck 14 is located the headstock (not shown).

In the prior art electric guitar 12, the pick guard 18 is held to the body 10 by screws 20 around the pick guard 18 that extend through the pick guard 18 into the body 10. The screws 20 hold the pick guard 18 into position along with the neck pickup 22, middle pickup 24 and the bridge pickup 26.

The blade switch pick up selector 33 may be used to select either the neck pickup 22, middle pickup 24, or bridge pickup 26. Control knobs 28, 30 and 32 adjust the neck pick up 22, middle bridge pickup 24 and bridge pickup 26, respectively, for volume and tone.

An output jack plate 29 covers the output jack route 31. The output jack 27 connects through the output jack plate 29.

A bridge 35 is secured to the guitar body 10 to hold the guitar strings (not shown) in position. A vibrato arm 37 extends through the end of the bridge 35 to adjust the tension of the strings on the bridge 35.

Figure 2:
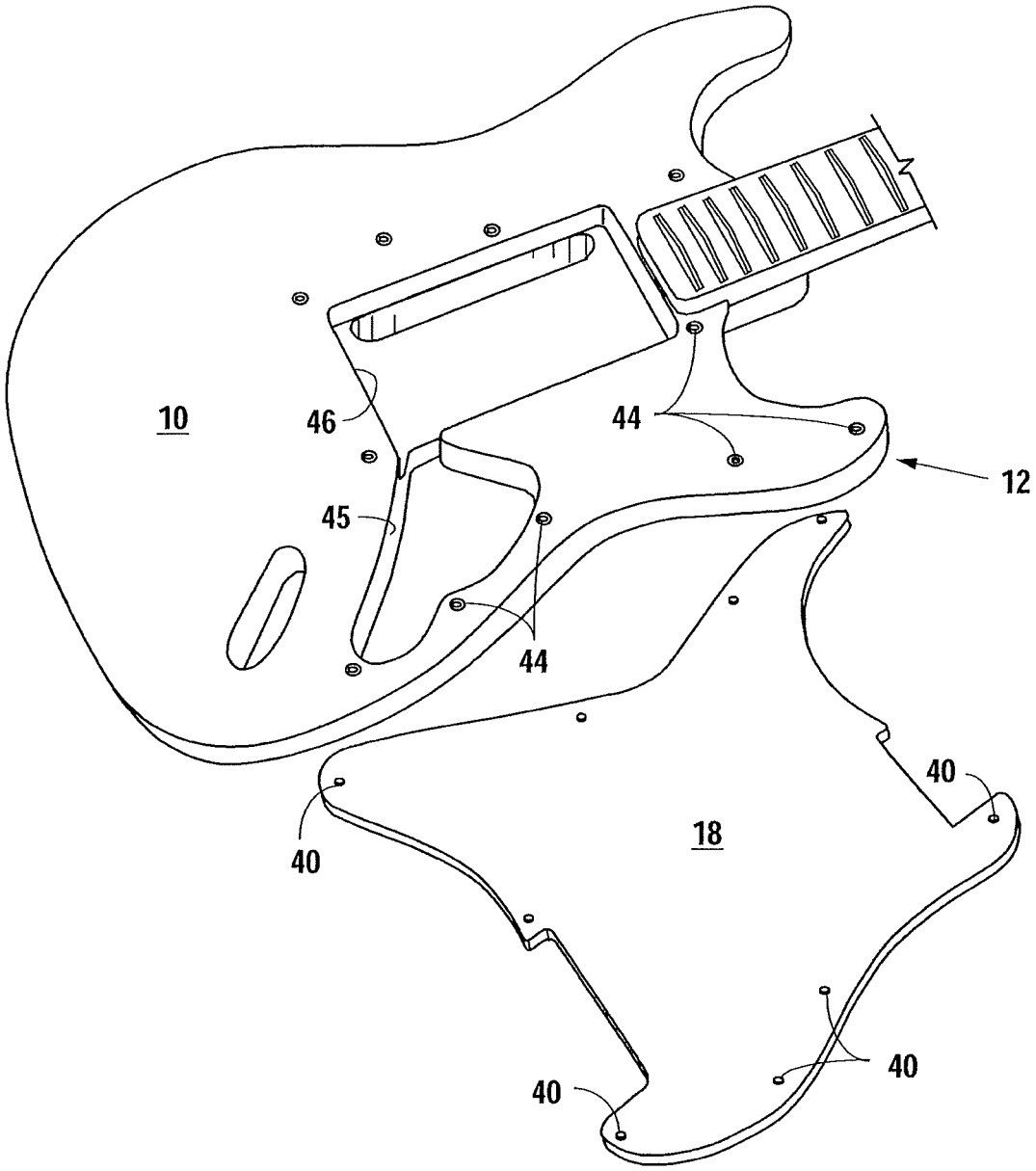
FIG. 2 is a front perspective view of a body portion of an electric guitar having the present invention with strings removed and a pick guard laid too one side.

Referring to FIG. 2, the guitar 12 is as shown in FIG. 1 is taken apart. The pick guard 18 is moved to the side. The screws 20 as shown in connection with FIG. 1 have been replaced with magnets 40, which magnetically connect to magnet holes 44 shown in the guitar body 10. The pick guard 18 is connected to the guitar body 10 by magnetically connecting each of the magnets 40 with the magnet holes 44 to cover the opening by the swimming pool route 46 and the control cavity 45.

Figure 6:
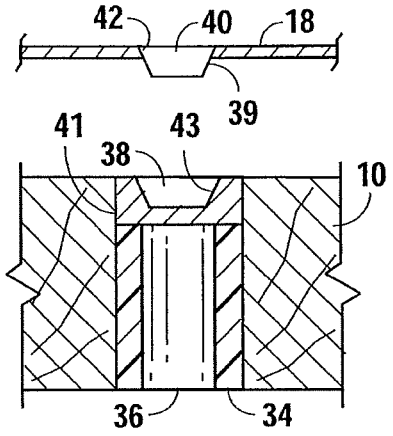
FIG. 6 is a cross-sectional view of a magnetic connector used in the present invention.

Referring to FIG. 6 and the exploded partial sectional view shown therein, the magnets 40 as contained in the pick guard 18 are shown. The magnets 40 are located in a countersink 42 of the pick guard 18. The beveled edge 39 of the magnet 40 matches the slope of the countersink 42. The magnets 40 may be held in the pick guard 18 by any conventional means such as glue or epoxy.

Mounted in the guitar body 10 is a Teflon® insert 34 that has a space 38 at the top of a magnetic receiver 41 to receive the lower part of the magnet 40 therein. The magnetic receiver 41 has a conical shape for quickly receiving magnets 40 therein. Magnets 40 have a similar shape on the lower part thereof that matches the conical shape 43 of the magnetic receiver 41. Inside of the Teflon® insert 34 is located a bar magnet 36. The magnetic attraction between magnets 40 and bar magnet 36 will hold the pick guard 18 in place on the guitar body 10.

In alternative embodiments, the magnets 40 may be of any shape. The magnets may be cylindrical (not shown), with a mating ring magnet (not shown) mounted in the guitar body. In another embodiment, the magnets could be spherical with a mating shape being in the guitar body. In another alternative embodiment, the Teflon ring may be eliminated and replaced with a cylindrical magnet. The configurations of magnets 40 and magnet receiver 44 are almost endless. The primary consideration is the magnets 40 be contained in the pick guard 18 to give a smooth outer surface, yet some indentation be in magnet receiver 44 mounted in the guitar body 10 to receive the magnets 40 therein.

Figure 3:
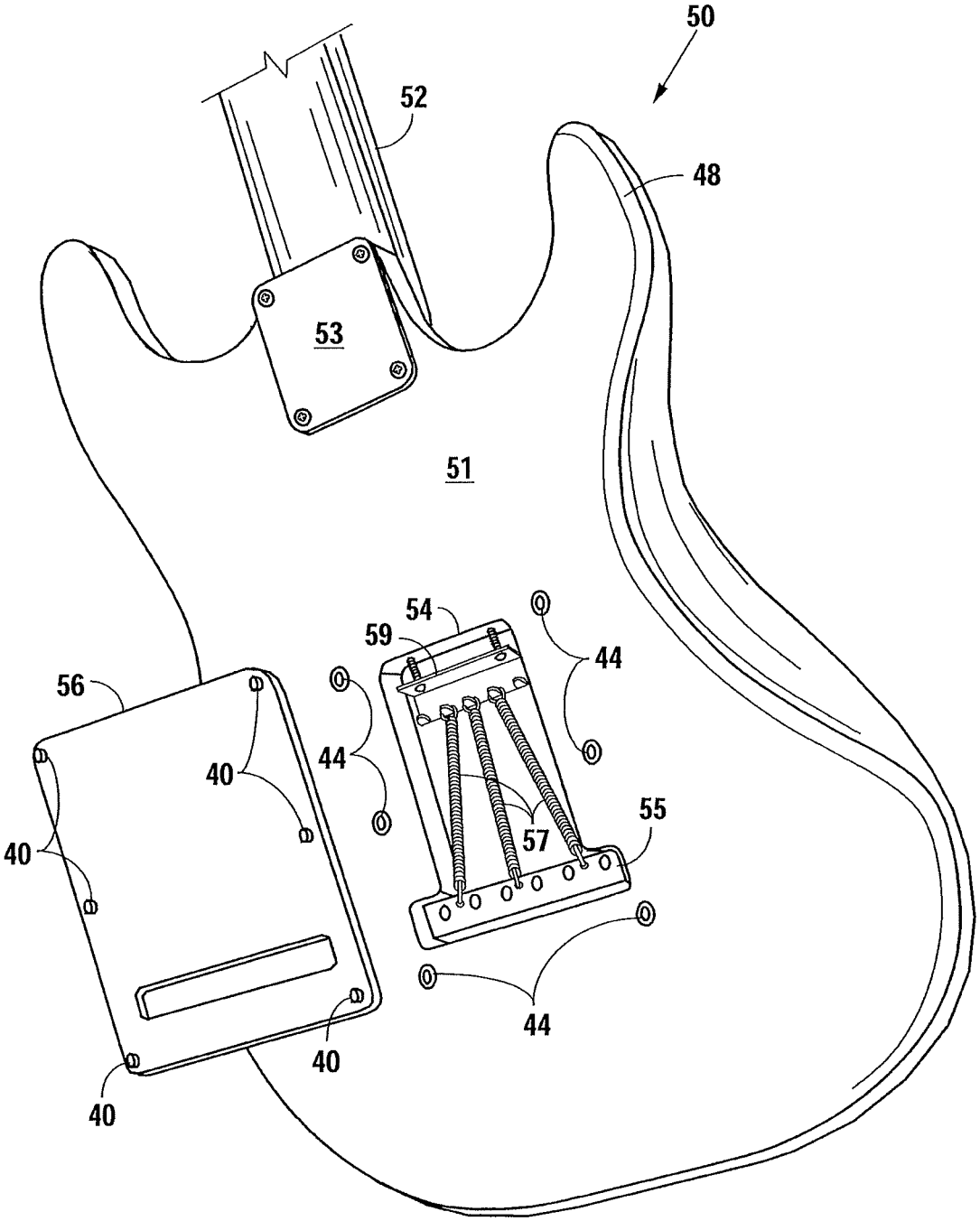
FIG. 3 is a rear perspective view of a body portion of an electric guitar with the vibrato spring cavity cover plate removed.

Referring now to FIG. 3, the back of a different guitar 50 is shown. The guitar 50 has a neck 52 and a neck plate 53 that combines the neck 52 with the guitar body 51 with screws (not shown). In the back of the guitar body 51 is located a vibrato spring route 54 in which is located a vibrato block 55 with vibrato springs 57 being secured by spring claw 59. The vibrato spring route 54 is covered by vibrato spring cover 56, which is held in position by magnets 40 magnetically connecting to magnet holes 44 as previously described in conjunction with FIG. 6. The vibrato spring cover 56 can be quickly removed by overcoming the magnetic force of the magnets 40 as connected in the magnet holes 44. The guitar 50 as shown in FIG. 3 is what is commonly referred to as a rear-loaded guitar. However, the features shown in FIG. 3 are common to both front and rear loading guitars.

Figure 4:
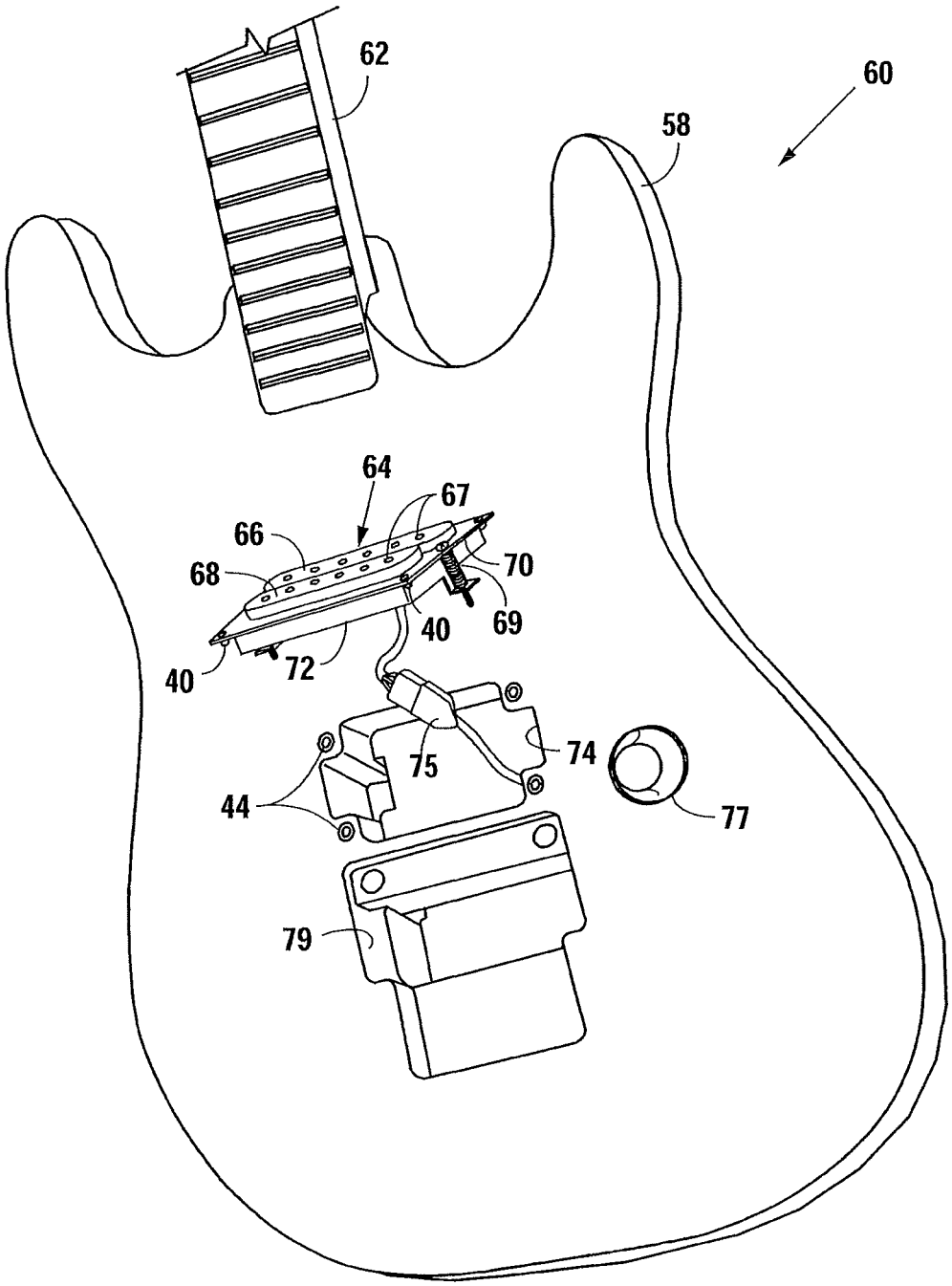
FIG. 4 is a front perspective view of a body portion of an electric guitar with strings removed and the guitar pickup mount system removed in what is called a rear-loaded electric guitar.

Referring to FIG. 4, a rear loaded guitar 60 with a guitar body 58 and a neck 62 is shown. The guitar 60 has a humbucking pickup 64 that includes bobbins 66 and 68 mounted on pickup mounting ring 70. Magnets 40, along with magnetic holes 44 hold the humbucking pickup 64 in place on the guitar body 58. Magnets 67 on the bobbins 66 and 68 pick up the sound created by the strings (not shown) that are stretched there across. Height adjustment screws 69 adjust the height of the bobbins 66 and 68.

The bottom 72 of the humbucking pickup 64 is inserted into pickup route 74 after connecting the miniature plug 75, which carries the signal detected by the magnets 67 in bobbins 66 and 68. Again, magnets 40 and magnetic holes 44 hold the humbucking pickup 64 in place. Volume control 77 controls the volume of the signal being received. Also, a bridge route 79 is provided in the guitar body 58.

Figure 5A:
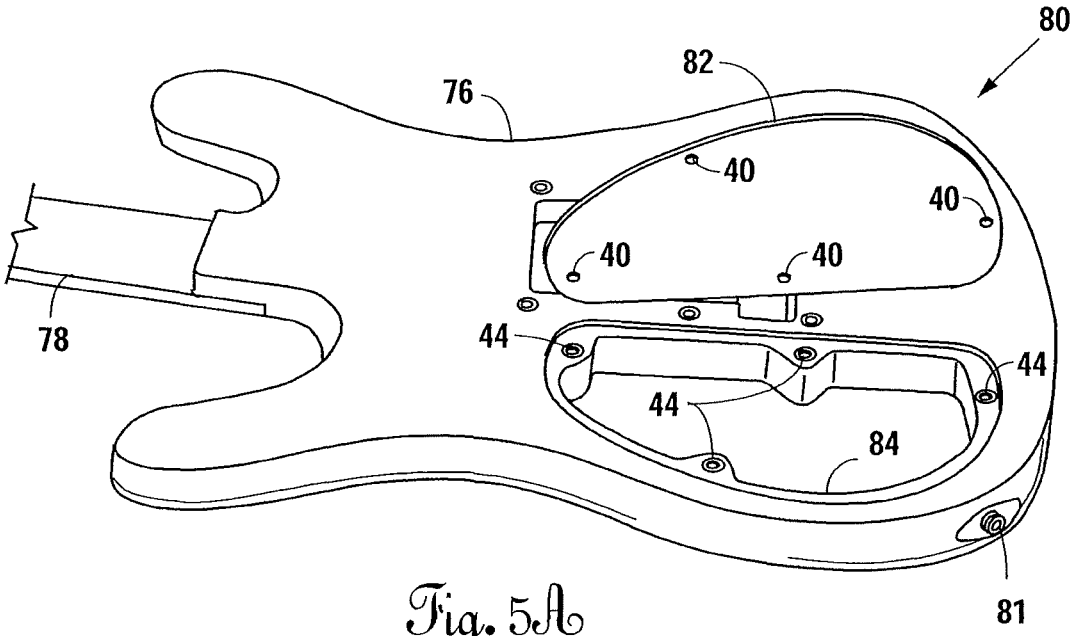
FIG. 5A is a rear perspective view of a body portion of an electric guitar with the guitar body control cavity cover plate being removed.
Figure 5B:
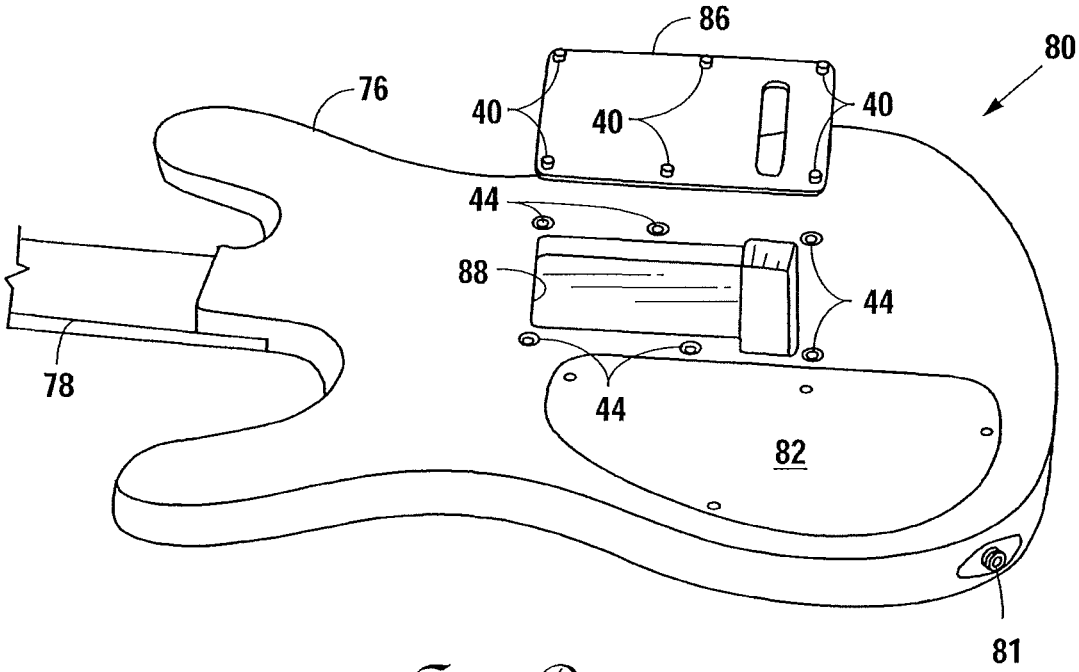
FIG. 5B is a rear perspective rear view of a body portion of an electric guitar with the vibrato spring cover plate removed.

Referring to FIGS. 5A and 5B in combination, the backside 80 of a rear load guitar is shown that includes a neck 78 and body 76. A control cavity route 84 is enclosed by control cavity cover 82, which is held in position by magnets 40 connecting to magnetic holes 44. Electrical outputs from the internal electronics (not shown) are fed through the output jack 81 to the amplifiers (not shown) for the sound system. The vibrato spring route 88 is enclosed by the vibrato spring cover 86, which is also held in position by magnets 40 connecting to magnet holes 44. Both the vibrato string cover 86 and the control cavity cover 82 can be quickly removed by overcoming the magnetic force holding them in place. No screws or screwdrivers are required.

The magnet 40 extends approximately 1/16" below the pick guard 18 which helps to ensure the pick guard cover 18 is in the proper position and does not shift when operating the blade switch pickup selector 33 shown in FIG. 1.

Figure 7:
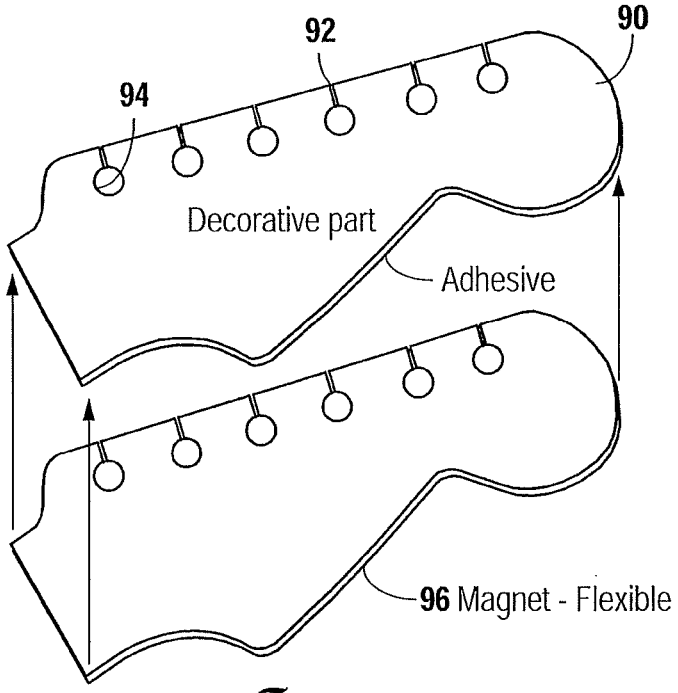
FIG. 7 is an exploded perspective view of the decorative laminate applied to the headstock of a guitar.

Essentially all guitars have a head stock where the guitar strings can be adjusted. The present invention includes adding a decorative laminate 90 attached to the head stock (not shown) of a guitar (see FIG. 7). The decorative laminate 90 would have slots 92 connected to tuner holes 94 to allow removal and replacement without removing strings (not shown). A flexible magnet 96 is adhesively attached to the underside of the decorative laminate 90. In that manner, the decorative laminate 90 can be quickly attached to the head stock of any guitar. By changing the decoration on the decorative laminate 90, the look or appearance of the guitar can be changed. It is possible to match the decorative laminate 90 with whatever decoration is on the pick guard 18. Hence, the decoration as contained on the head stock can be made to match the decoration as contained in the pick guard.

Figure 8:
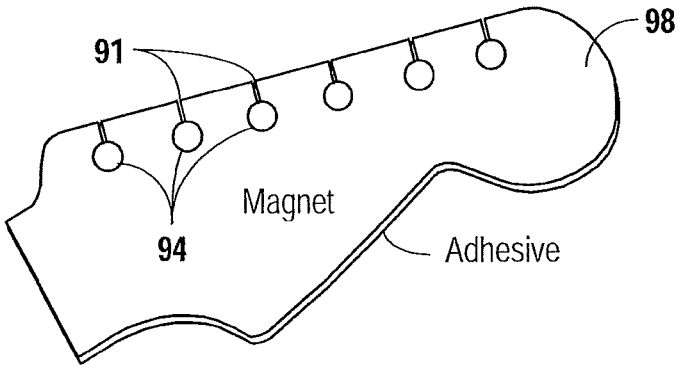
FIG. 8 is a perspective view of a flexible magnet that may be attached to the headstock of a guitar.

FIG. 8 shows an alternative embodiment where a flexible magnet 98 is glued to the headstock. The flexible magnet 98 may, or may not, have slots 91 connecting to the tuner holes 94.

Figure 9:
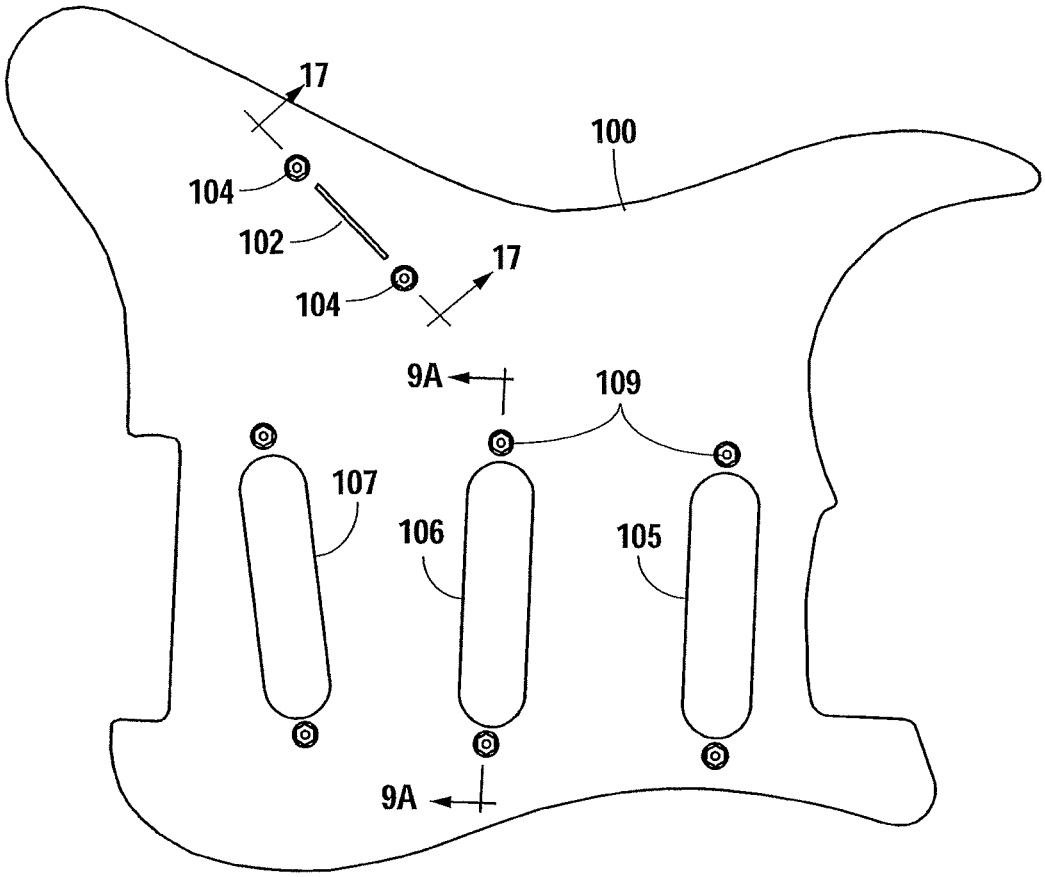
FIG. 9 is a back view of a pick guard cover with screw inserts.
Figure 9A:
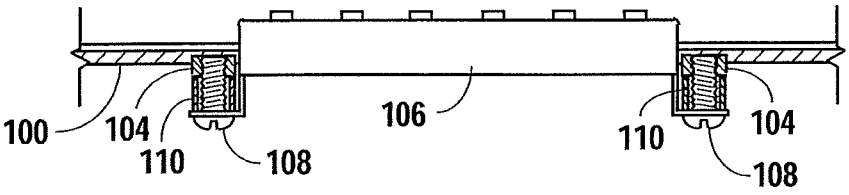
FIG. 9A is a cross-sectional view of FIG. 9 along section lines 9A-9A.

FIG. 9 is the backside of pick guard 100. Bobbins 105, 106, and 107 are located in pick guard 100. Referring to the cross-sectional view shown in Section 9A-9A, bobbin 106 is shown mounted in pick guard 100. Screw inserts 104 are attached to the backside of pick guard 100 by any conventional means, such as press fit and/or gluing. Mounting screws 108, which are surrounded by mounting springs 110 located there around, are threadably connected to the screw inserts 104 to hold the bobbin 106 in position. This allows for the front of the pick guard 100 to appear smooth and screw-less.

Also mounted in the pick guard 100 is the switch slot 102 that also has the screw inserts 104 mounted on the backside of pick guard 100. This will be explained in more detail herein below in conjunction with FIG. 17.

Figure 10:
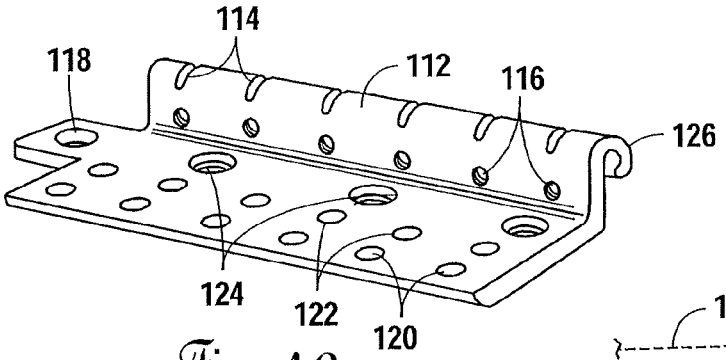
FIG. 10 is a perspective view of a tech bridge.
Figure 11:
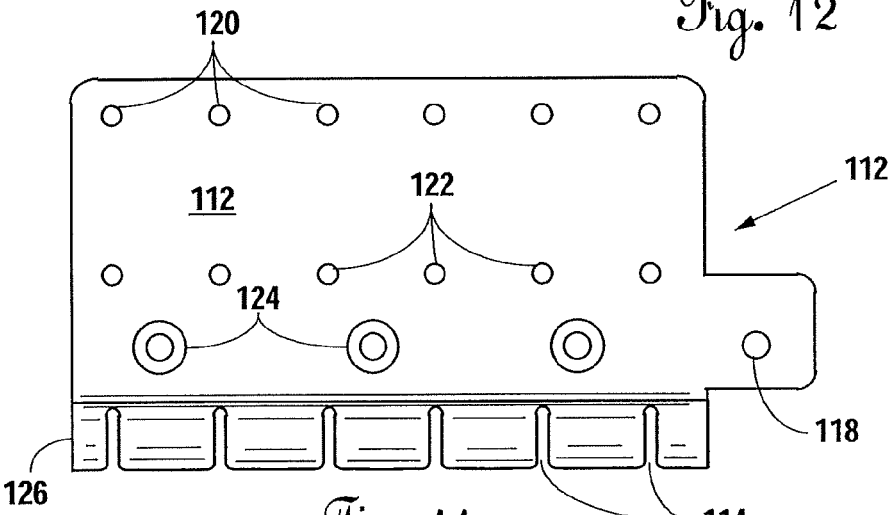
FIG. 11 is a top view of the tech bridge shown in FIG. 10.
Figure 13:
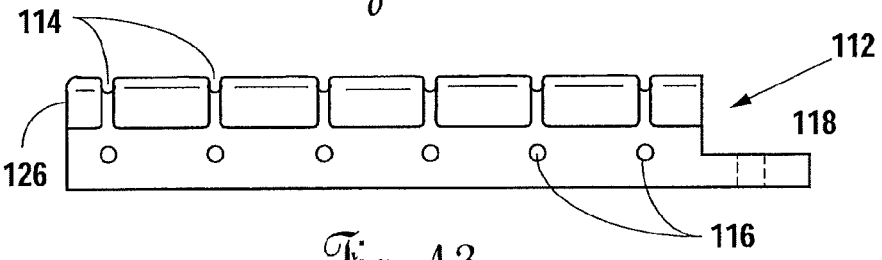
FIG. 13 is a back view of the tech bridge shown in FIG. 11.

Referring now to FIGS. 10, 11 and 13 in combination, a tech bridge 112 is shown. The tech bridge 112 is not the same as the bridge 35 shown in FIG. 1. The tech bridge 112 has string slots 114 through which the individual guitar strings are strung. Beneath the string slots 114 are saddle adjustment screw holes 116.

On one end of the tech bridge 112 is the vibrato aim receptacle 118 through which a vibrato arm can be inserted. The tech bridge 112 has bridge plate mounting screw holes 120 in one edge thereof and string holes 122 towards the middle thereof. Vibrato block mounting screw holes 124 are also provided in the tech bridge 112.

Figure 22:
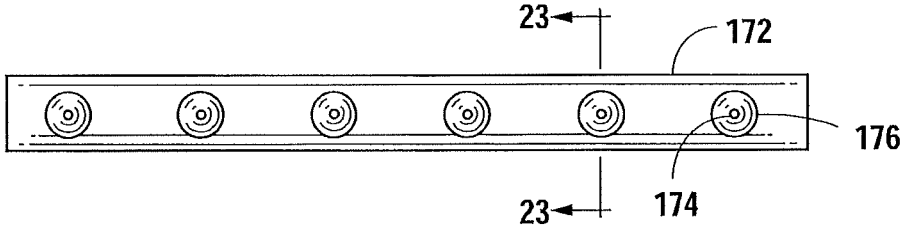
FIG. 22 is a back view of the string retention bar.
Figure 23:
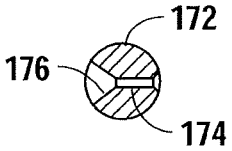
FIG. 23 is a cross-sectional view of FIG. 22 along section lines 23-23.
Figure 24:
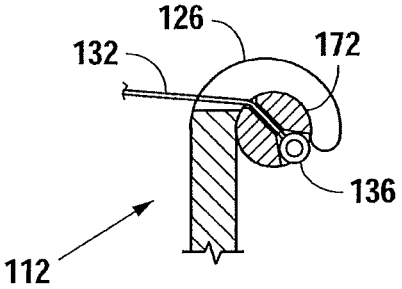
FIG. 24 is a partial cross-sectional view of the tech bridge with a string retainer bar and strings in place.

Referring now to FIGS. 22, 23 and 24 in combination, a string retainer bar 172 is shown. As can be seen in the cross-sectional view of FIG. 23, the string retainer bar 172 has a countersink connected to string holes 174 which receive each of the individual guitar strings therein. Once the strings of the guitar are in place in each of the respective string holes 174, the guitar strings 132 connect through the string retainer bar 172 to the ball end 136. Then, the entire string retainer bar 172 is located inside of the string retainer bar seat 126 of the tech bridge 112.

Figure 12:
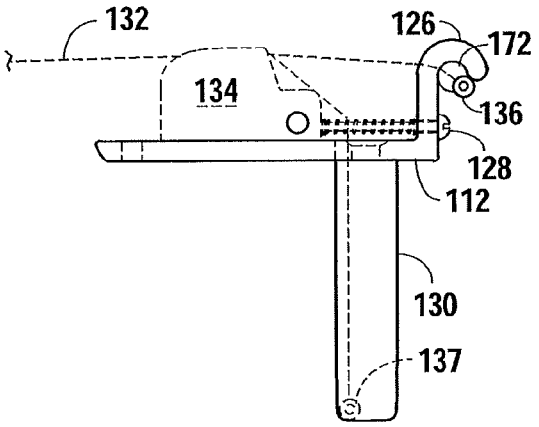
FIG. 12 is an end view of the tech bridge shown in FIG. 10 with broken lines illustrating alternative ways of connecting guitar strings.

Referring back to FIG. 12, the string retainer bar seat 126 is clearly shown. The guitar strings 132 may extend over saddle 134, through the string retainer bar 172, and be attached to the ball end 136. Saddle adjustment screw 128 adjusts the length and tension on the guitar strings 132 by adjusting the saddle 134 and tech bridge 112. Vibrato block 130 connects to the tech bridge 112 via vibrato block mounting screw holes 124 as seen in FIGS. 10 and 11. The strings 132 of the guitar come across the saddle 134. In the preferred embodiment, the strings 132 will connect through the string retainer bar 172 to the ball end 136. However, in an alternative embodiment, the strings 132 may connect to the bottom of the vibrato block 130 to the ball end 137 located at the bottom thereof. While it is envisioned that the strings 132 would go either through the string retainer bar 172 or to the bottom of the vibrato block 130, the strings 132 could have any combination thereof, including some that go to the bottom of the vibrato block 30 and some going through the string retainer bar 172. However, for rapid access function of this invention, all strings 132 should be attached through the string retainer bar 172.

Figure 14:
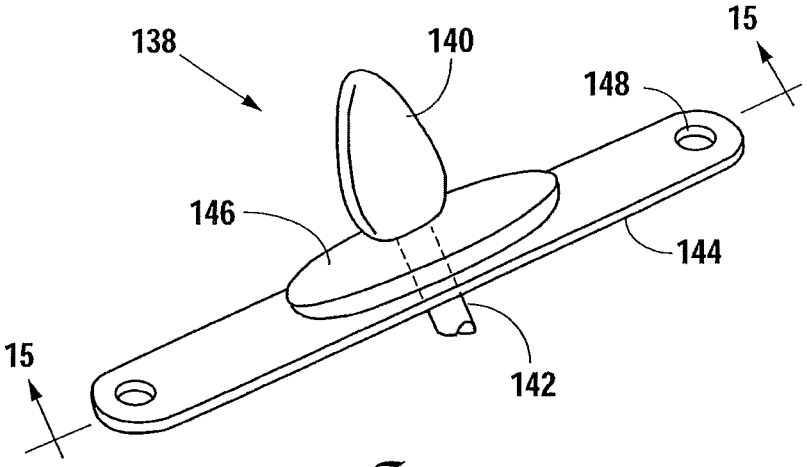
FIG. 14 is a perspective view of the pickup selector switch with a protective boot.
Figure 15:
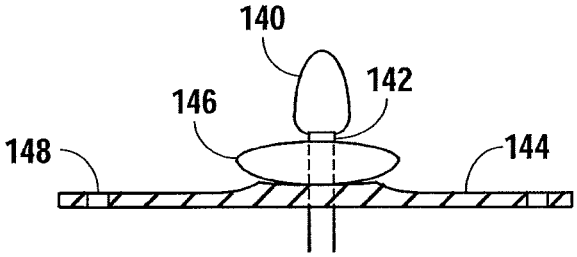
FIG. 15 is a cross-sectional view of FIG. 14 along section lines 15-15.

Referring now to FIGS. 14 and 15 in combination, a selector switch 138 is shown. A switch tip 140 connects through switch lever 142 to an internal selector switch (not shown) in a guitar. Covering the opening for the selector switch is a switch boot 144 which may be held in position by switch boot mounting holes 148. Above the switch boot 144 is the boot top 146 which is generally a donut configuration in shape. The boot top 146 moves back and forth as the lever 142 moves back and forth.

Figure 16:
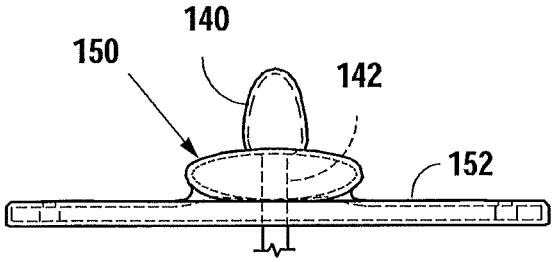
FIG. 16 is a side view of an alternative pick up selector switch with boot.
Figure 17:
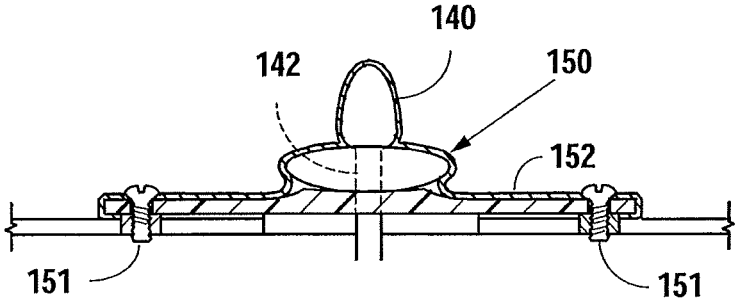
FIG. 17 is a partial cross-sectional view of FIG. 16 showing boot screwed in place on the pick guard.

Referring to FIG. 9 along section lines 17-17, a cross-sectional view of a monolithic switch boot 150 is shown. FIGS. 16 and 17 show the monolithic switch boot 150. The monolithic switch boot 150 consists of a rubber boot 152 that encapsulates the switch tip 140 and the switch lever 142.

The entire monolithic switch boot 150 is held into position by mounting screws 151 or magnets 40 as previously described in prior figures.

Figure 19:
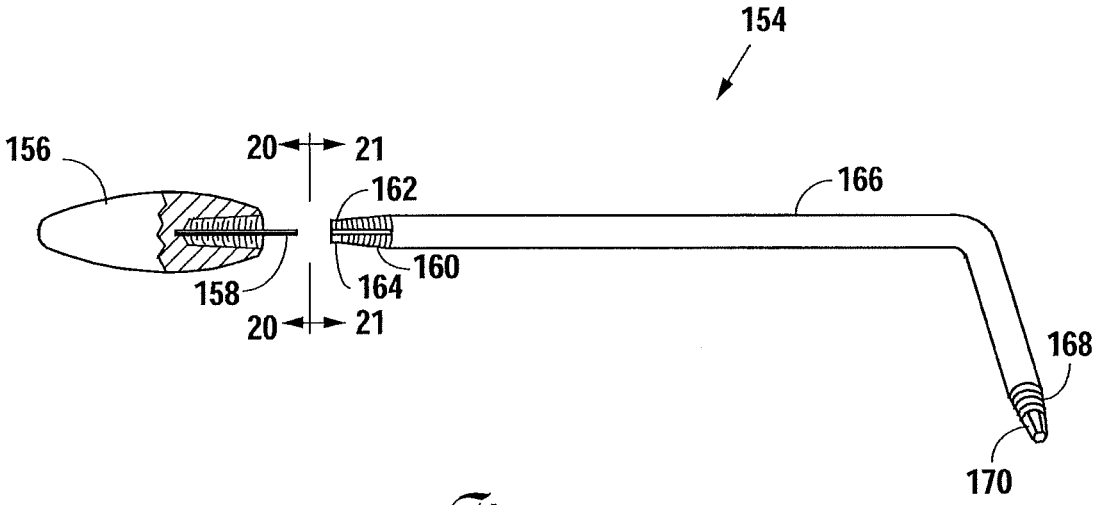
FIG. 19 is an exploded perspective view of the vibrato arm and vibrato arm tip.
Figure 20:
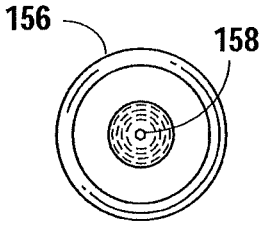
FIG. 20 is a view of FIG. 19 along lines 20-20.
Figure 21:
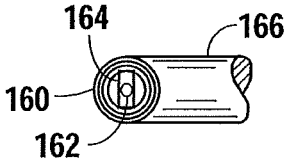
FIG. 21 is a view of FIG. 19 along lines 21-21.

Referring to FIGS. 19, 20 and 21 in combination, a vibrato arm 154 is shown. Vibrato arm has a vibrato arm tip 156 mounted on one end thereof by vibrato aim threads 160. Inside the vibrato arm tip 150 is an Allen wrench hex tool 158. The Allen wrench hex tool 158 will be received inside of Allen wrench hole 162 of the vibrato arm 166. On the end of the vibrato arm 166 inside of vibrato arm tip 156 is a flathead screwdriver 164. The opposite end of the vibrato arm 166 is connected by threads 168. At the end of the threads 168 is located a p Phillips head screwdriver 170. The Allen wrench hex tool 158, flathead screwdriver 164 and Phillips head screwdriver 170 can be used to repair most items on a guitar. Therefore, by using a vibrato arm 154 as described in conjunction with FIGS. 19 through 21, a tool kit for the guitar is described and shown.

Figure 18:
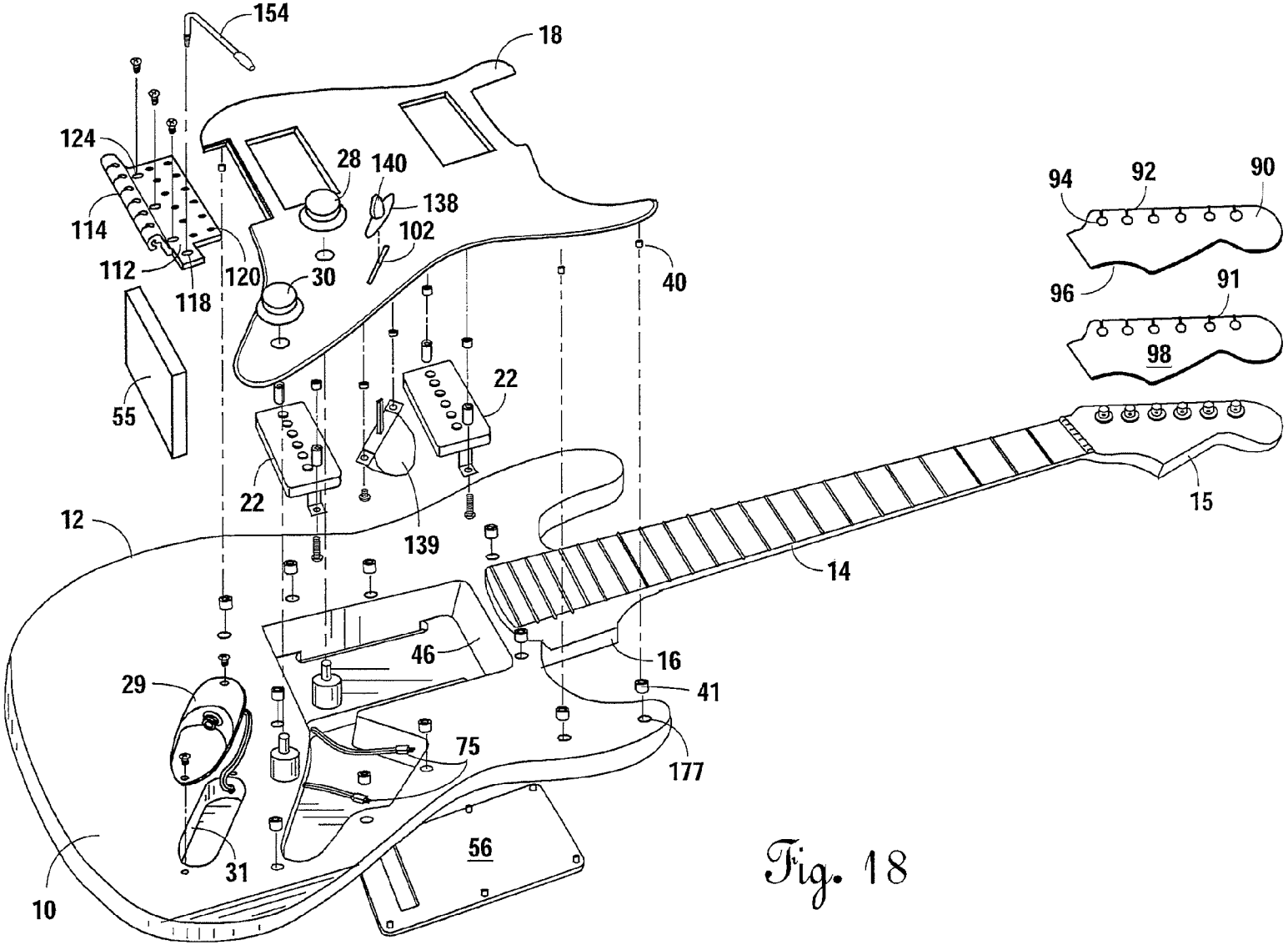
FIG. 18 is an exploded perspective view of a guitar having the present invention.

Referring now to FIG. 18, an exploded perspective view of the present invention, giving its features, is shown. The guitar 12 has a guitar body 10 with a neck 14 and head stock 15. The design on the head stock 15 can be changed by changing the flexible magnet 98 and/or the decorative laminate 90. The magnets 40 which are secured on the underside of the pick guard 18 connect to magnetic receivers 41 mounted in holes 177 of the guitar body 10. Guitar pickups 22 are located inside of swimming pool route 46. Control knobs 28 and 30 are mounted on the top of the pick guard 18. Switch slot 102 is covered by pickup selector switch boot 138 through which switch tip 140 extends.

Tech bridge 112 has vibrato block 55 located there below. Vibrato arm 154 may adjust the tech bridge 112 by adjusting the vibrato block 55. The vibrato arm 154 extends through vibrato arm receptacle 118 to connect to the vibrato block 55. The output jack route 31 is covered by the output jack plate 29. On the backside, vibrato spring route 54 is covered by vibrato spring cover 56.

By use of the present system, a guitar may be changed very quickly to have a different sound or look. By movement of the vibrato arm 154, a wobbling type of effect can be given to the sound. Other musical controls can be caused by the selector tip 140 or the control knobs 28 or 30. The entire electrical harness is connected with miniature plugs 35 (see FIG. 4) for quick disconnect or reconnection.

Figure 25:
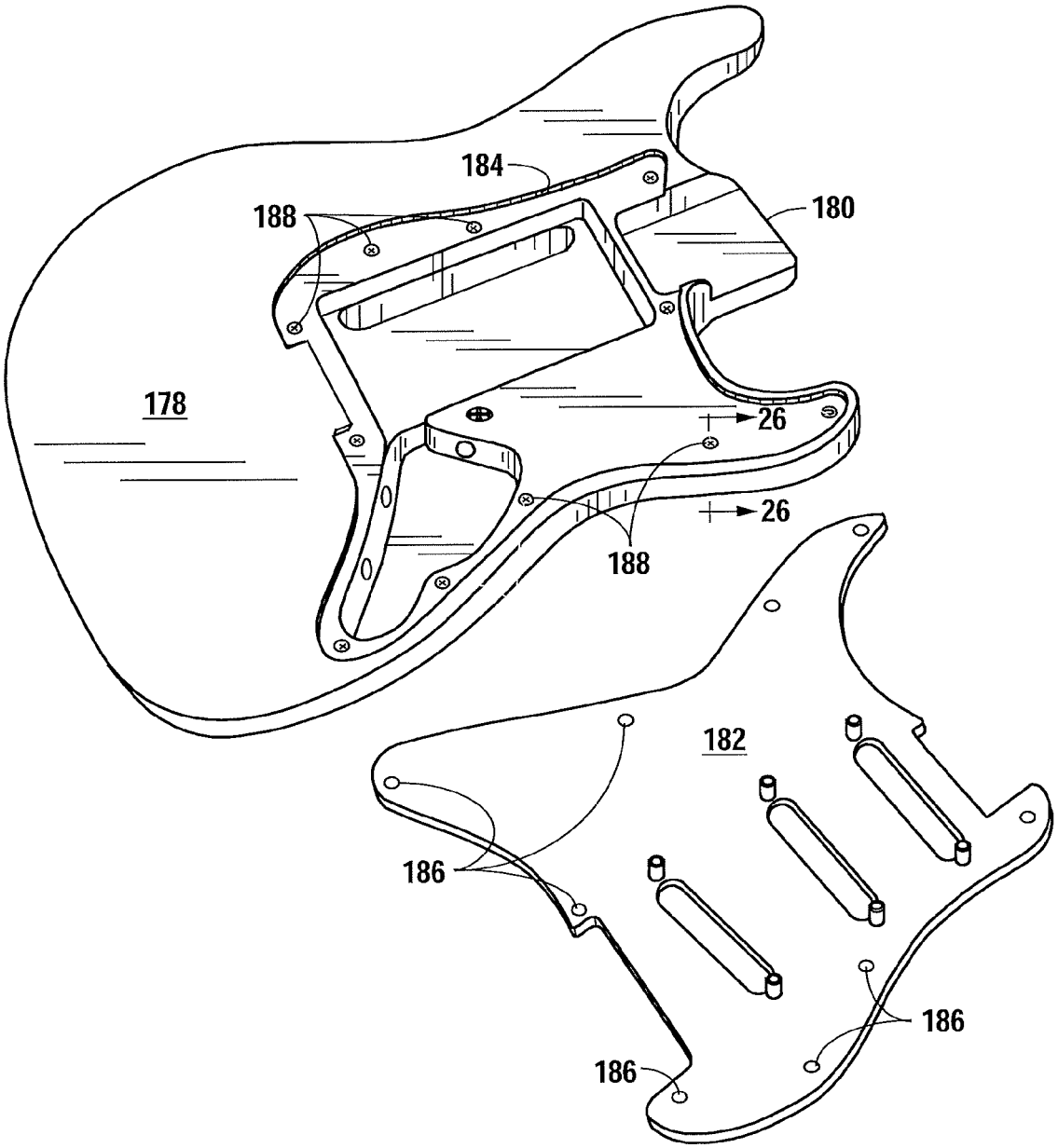
FIG. 25 is a front perspective view of the body portion of an electric guitar having the present invention with the strings removed and a guitar pick guard laid to one side.

Referring to FIG. 25, an alternative embodiment of the present invention is shown. A guitar body 178 has the guitar neck removed (not shown) but with the heel 180 remaining The pick guard 182 is moved to one side. The guitar body 178 has a pick guard cut-out 184 therein. The pick guard cut-out 184 is just large enough for the pick guard 182 to fit inside thereof.

On the underside of the pick guard 182 are a series of washers 186. The washers 186 are on with the underside of pick guard 182. The washers 186 do not extend through the pick guard 182 to the top surface thereof. Under each of the washers 186 in the guitar body 178 are magnetic screws 188.

Figure 26:
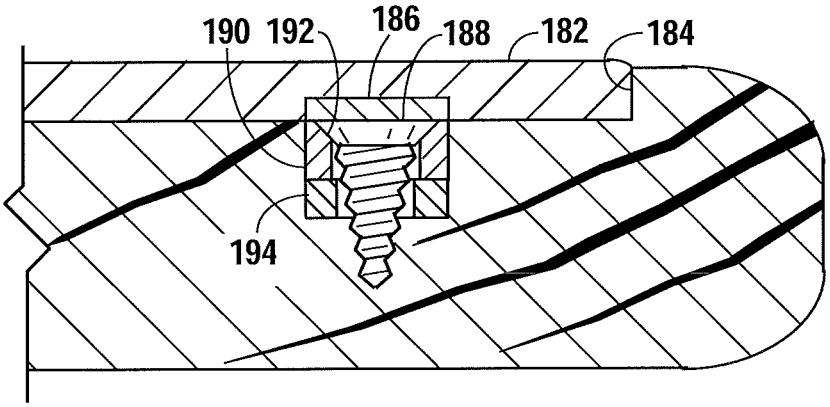
FIG. 26 is a cross-sectional view of FIG. 25 along section lines 26-26.

Referring to FIG. 26, a cross-sectional view of the ferromagnetic screws 188 is shown. The pick guard 182 fits just inside of the pick guard cut-out 184. The washers 186 are located in pick guard 182 immediately above each of the ferromagnetic screws 188. The ferromagnetic screws 188 are made of ferromagnetic material and have a magnetic sleeve 190 there around. The upper part of the magnetic sleeve 190 has a beveled upper surface 192 for the underside of the head of the ferromagnetic screws 188 to rest there against.

Below the magnetic sleeve 190 is rubber washer 194. The magnetic attraction of the magnetic sleeve 190 projects through the ferromagnetic screws 188 to attract the washers 186, which washers are made of ferromagnetic material, the same as ferromagnetic screws 188. Therefore, when the pick guard 182 is placed inside of the pick guard cut-out 184, the magnetic attraction created by the magnetic sleeve 190 for the washers 186 will hold the pick guard 182 in place.

Figure 27:
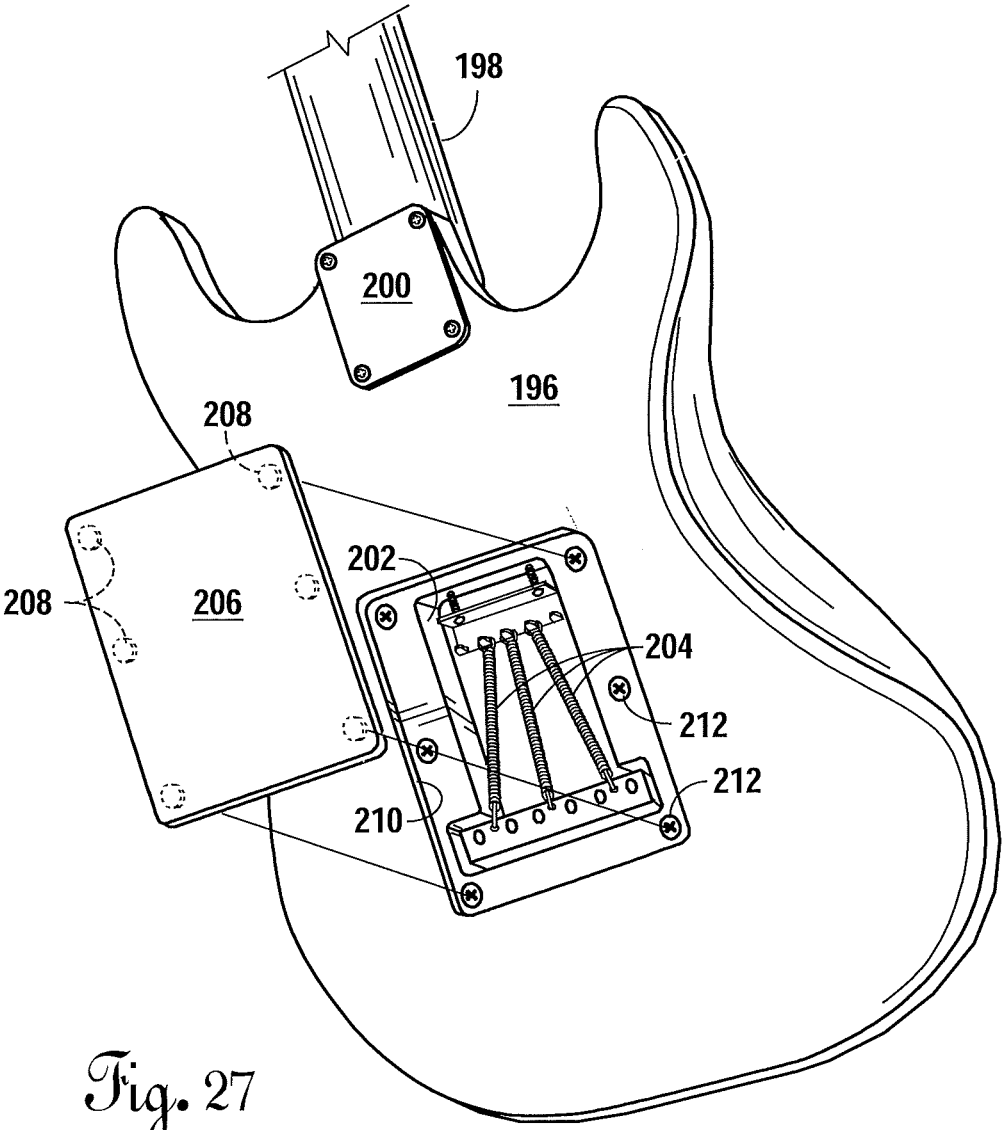
FIG. 27 is a rear perspective view of a body portion of an electric guitar with the vibrato spring cavity cover plate removed.

Referring to FIG. 27, the rear of guitar body 196 is shown with a guitar neck 198 attached thereto with a neck plate 200. A vibrato spring route 202 contains vibrato springs 204, which are covered by vibrato spring cover 206.

Just as described in conjunction with FIGS. 25 and 26, vibrato springs cover 206 has ferromagnetic washers 208 located on the undersigned vibrato springs cover 206. The guitar body 196 has a vibrato springs cover cut-out 210, which cut-out 210 is just large enough to receive the vibrato springs cover 206 therein. Magnetic screws 212 are located immediately below each of the washers 208. The magnetic screws 212 are constructed in the same manner as the magnetic screws 188 described in conjunction with FIG. 26. The magnetic attraction by the magnetic screws 212 to the washers 208 will hold the vibrato springs cover in place.

Figure 28:
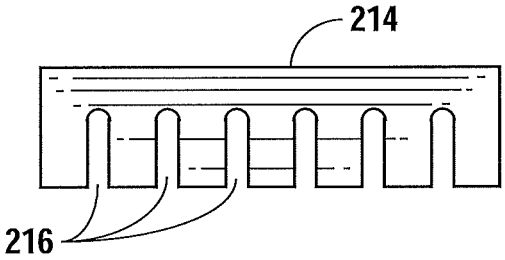
FIG. 28 is a top view of a saddle wedge.
Figure 29:
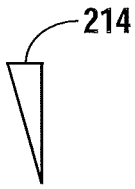
FIG. 29 is an end view of a saddle wedge.
Figure 30:
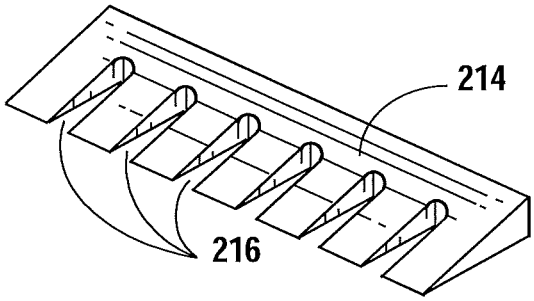
FIG. 30 is a perspective view of a saddle wedge.

Referring to FIGS. 28, 29 and 30 in combination, a saddle wedge 214 is shown. The saddle wedge 214 has slots 216 therein, which slots allow the guitar strings to pass there through.

Figure 31:
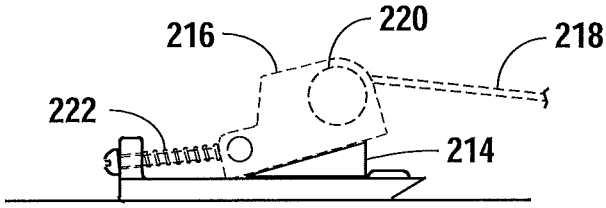
FIG. 31 is a side view of a saddle wedge being inserted under a saddle to raise guitar strings.

Referring to FIG. 31, the saddle wedge 214 is shown in use below saddle 216. Guitar string 218 connects to string retainer bar 220. Position of the saddle 216 may be adjusted by saddle adjustment screw 222. Saddle wedge 214 allows for additional adjustment in the height of the guitar string 218 to facilitate ease of playing slide guitar styles.

I claim:

1. An electric guitar system that allows for someone to make fast changes to (a) appearance of a guitar or (b) sound of the guitar; said system having a body, headstock, neck, strings, saddles and pickups; said strings being attached from said headstock, down said neck, over said pickups and across said saddle; said electric guitar system comprising:

openings within said body of said guitar, said openings providing (a) space therein for electronics for said guitar and (b) anchoring of one end of said strings;

covers over said openings;

cut-outs in said body to receive said covers therein and hold said covers in place;

ferromagnetic washers secured around an outer periphery of said covers;

magnets secured in said body below where said ferromagnetic washers are normally located during use of said guitar;

magnetic attraction between said magnets and said ferromagnetic washers holding said covers in place over said openings within said body, one of said covers being a pick guard;

after disconnection of said strings, said magnetic attraction holding said pick guard can be overcome by said someone pulling on said pick guard cover which allows (1) changes to sound of said guitar or (2) said pick guard cover to be replaced to give a different decoration on an outer surface thereof.

2. The electric guitar system as given in claim 1 wherein said ferromagnetic washers are located above said magnets.

3. The electric guitar system as given in claim 2 wherein a removable decorative laminate covers said headstock under said strings, decorative pattern of said removable decorative laminate matching a decorative pattern as shown on said pick guard cover.

4. The electric guitar system as given in claim 3 wherein said strings are attached on one end thereof to a string retainer bar, which string retainer bar is normally located in a string retainer bar seat of a tech bridge located adjacent said saddle on said body, said string retainer bar having beveled holes for receiving each of said strings there through for anchoring on a ball end of said strings.

5. The electric guitar system as given in claim 4 further having a vibrato arm extending through said tech bridge into a vibrato block, said vibrato arm tightening or loosening said strings by adjusting said vibrato block.

6. The electric guitar system as given in claim 5 wherein upon loosening said strings with said vibrato arm, said string retainer bar and all of said strings can be disconnected from said tech bridge to allow internal access to said guitar.

7. The electric guitar system as given in claim 5 wherein said vibrato arm has tools mounted in an end thereof including (a) a flathead screwdriver, (b) a Phillip head screwdriver and (c) an Allen wrench.

8. The electric guitar system as given in claim 1 includes a boot over one of said openings having a selector switch therein, said boot preventing contaminants from entering through said openings containing said selector switch.

9. The electric guitar system as given in claim 8 wherein bobbins are secured on a backside of said pick guard by screw inserts and screws while allowing a front side of said pick guard cover to be smooth.

10. The electric guitar system as given in claim 1 wherein said magnets are held by ferromagnetic screws within the cut-outs of said body.

11. The electric guitar system as given in claim 1 further includes a wedge below said saddle to adjust height of said strings.

* * * * *